US010202899B2

(12) United States Patent
Schwenck et al.

(10) Patent No.: US 10,202,899 B2
(45) Date of Patent: Feb. 12, 2019

(54) DEVICE FOR COMPENSATING FOR THE OPERATING CLEARANCES OF AN ENGINE

(71) Applicants: MCE-5 Development S.A., Lyons (FR); Vianney Rabhi, Lyons (FR)

(72) Inventors: Benoit Schwenck, Lyons (FR); Sylvain Bigot, Idron (FR); Francois Besson, Decines-charpieu (FR)

(73) Assignee: MCE-5 Development S.A., Lyons (FR)

( * ) Notice: Subject to any disclaimer, the term of this patent is extended or adjusted under 35 U.S.C. 154(b) by 0 days.

(21) Appl. No.: 15/518,977

(22) PCT Filed: Aug. 5, 2015

(86) PCT No.: PCT/EP2015/068105

§ 371 (c)(1),
(2) Date: Apr. 13, 2017

(87) PCT Pub. No.: WO2016/058724

PCT Pub. Date: Apr. 21, 2016

(65) Prior Publication Data

US 2017/0234215 A1 Aug. 17, 2017

(30) Foreign Application Priority Data

Oct. 13, 2014 (FR) ..... 14 59791

(51) Int. Cl.

| | |
|---|---|
| ***F02B 75/04*** | (2006.01) |
| ***F01B 9/02*** | (2006.01) |
| ***F01B 9/04*** | (2006.01) |
| ***F02B 75/32*** | (2006.01) |

(52) U.S. Cl.
CPC ..... *F02B 75/044* (2013.01); *F01B 9/026* (2013.01); *F01B 9/047* (2013.01); *F02B 75/045* (2013.01); *F02B 75/32* (2013.01)

(58) Field of Classification Search
CPC ..... F02B 75/044; F02B 75/32; F02B 75/045; F01B 9/026; F01B 9/047
See application file for complete search history.

(56) References Cited

U.S. PATENT DOCUMENTS

| | | | |
|---|---|---|---|
| 5,495,923 | A | 3/1996 | Bruski et al. |
| 7,537,097 | B2 | 5/2009 | Suda et al. |
| 2008/0017023 | A1 | 1/2008 | Rabhi |

(Continued)

FOREIGN PATENT DOCUMENTS

| | | |
|---|---|---|
| EP | 1740810 | 5/2009 |
| EP | 1979591 | 5/2012 |

OTHER PUBLICATIONS

International Search Report for International Application No. PCT/EP2015/068105 dated Nov. 4, 2015, 2 pages.

(Continued)

*Primary Examiner* — Jacob Amick
(74) *Attorney, Agent, or Firm* — TraskBritt

(57) ABSTRACT

A device for compensating for the operating clearances of an engine comprising a transmission device likely to move transversely in an engine block) during an engine cycle includes a pressing device exerting a holding force on the transmission device. The holding force is adjusted to the instantaneous speed of transverse movement of the transmission device in the engine block.

20 Claims, 5 Drawing Sheets

(56) References Cited

U.S. PATENT DOCUMENTS

| | | | | |
|---|---|---|---|---|
| 2010/0206270 | A1* | 8/2010 | Rabhi | F01B 9/047<br>123/48 B |
| 2010/0224143 | A1 | 9/2010 | Rabhi | |
| 2010/0258074 | A1 | 10/2010 | Rabhi | |

OTHER PUBLICATIONS

International Written Opinion for International Application No. PCT/EP2015/068105 dated Nov. 4, 2015, 4 pages.
Office Action for Chinese Patent Application No. 201580067380.3 dated Oct. 31, 2018 (11 pages with English Translation).

* cited by examiner

DEVICE FOR COMPENSATING FOR THE OPERATING CLEARANCES OF AN ENGINE

CROSS-REFERENCE TO RELATED APPLICATIONS

This application is a national phase entry under 35 U.S.C. § 371 of International Patent Application PCT/EP2015/068105, filed Aug. 5, 2015, designating the United States of America and published as International Patent Publication WO 2016/058724 A1 on Apr. 21, 2016, which claims the benefit under Article 8 of the Patent Cooperation Treaty to French Patent Application Serial No. 1459791, filed Oct. 13, 2014.

TECHNICAL FIELD

The invention relates to a device for compensating for the operating clearances of an engine, and, in particular, of a variable compression ratio engine.

BACKGROUND

An engine transmission device comprises a set of moving components ensuring, or involved in, the transmission of the translation of the combustion piston in a cylinder to a rotation of a crankshaft.

Engines are known from the prior art that comprise a transmission device likely to move transversely, i.e., in a direction perpendicular to the translation axis of the combustion piston, in an engine block. This movement originates in the operating clearances existing between the moving components of the transmission device. Such operating clearances are particularly affected by the moving components manufacturing and assembling tolerances, the wear and the deformation under load thereof, and by the differential expansion of the engine parts subjected to different temperatures or made of materials having different coefficients of expansion.

The operating clearances should be perfectly controlled. If they are too big, they lead to excessive acoustic emissions of the engine when operating, accelerated deterioration of its components or even the destruction thereof, for example, caused by disengaging moving components. If they are too small, null or negative, they lead to excessive friction between the moving components and thus to a degraded engine performance, the blocking or even the destruction thereof.

The documents US 2010/206270, EP 1740810 and EP 1979591 disclose devices for adjusting the operating clearance existing between the moving components of a transmission device, with such devices comprising a spring or a hydraulic jack, integral with the engine block, and exerting a transverse force holding the transmission device to keep it in contact with an opposite wall of the engine block.

The above-mentioned documents provide for the application of a static load onto the transmission device. "Static load" means a constant force during an engine cycle. The static load is so calibrated as to oppose the maximum forces that apply to the transmission device, specifically for the engine working conditions (speed, load) generating the greatest forces. The static load ensures the permanent contact between the moving components of the device. It is therefore relatively important.

It should be noted that these documents provide for an embodiment making it possible to control the force exerted, for example, by a hydraulic jack, according to the engine working conditions. In this embodiment, however, when the engine operates under load and at a steady speed, the force exerted by the hydraulic jack is not affected.

Such relatively significant and permanent force induces frictions within the transmission device that affect the engine performance, and impose the adequate dimensioning of the transmission parts, the casing, and the hydraulic power source.

Therefore, it is sometimes chosen to calibrate the static holding force to a level below the maximum forces which apply to the transmission device, but nevertheless at a sufficient level to cover a part of the engine operating range. However, this solution is not satisfactory since it requires using a mechanical stop to limit the operating clearances as soon as the movement becomes excessive.

Upon assembly, such stop requires a fine adjustment specific to each subset associated with an engine cylinder. This operation is particularly undesirable on an industrial scale for reasons of cost.

In addition, the adjusted position of the stop also has the disadvantage of being stationary, and of not compensating for the phenomena related to the differential expansions between the casing and the transmission elements, or the offsets linked to the parts' wear, for example.

When the stop is biased in operation, the shocks are directly transmitted to the motor casing, which induces oversizing, accelerated wear of the impacted parts, and increased noise level.

The need for calibrating the holding force is particularly marked for a variable compression ratio engine, as described in the cited documents of the prior art, according to which a static holding force is applied to one side of a control rack, the longitudinal displacement of which ensures the control of the compression ratio. As a matter of fact, it is particularly important in this case to limit the static value of the holding force so as not to block or limit the movement capacity of the control rack, in particular, by sliding the control rack against the wall of the engine block.

BRIEF SUMMARY

One object of the invention is to provide a device for compensating for the operating clearances of an engine, which obviates the aforesaid drawbacks.

In order to achieve this object, the subject of the invention provides for a device for compensating for the operating clearances of an engine comprising:

- a transmission device likely to move transversely in an engine block during an engine cycle; and
- a pressing device exerting a holding force onto the transmission device.

The compensation device is characterized in that the holding force is adjusted to the instantaneous speed of transverse displacement of the transmission device in the engine block.

The compensating device thus enables the slow motions of the transmission device by applying a moderate holding force during these motions. It opposes the fast movement of the transmission device, mainly corresponding to the force peak associated with the combustion of a mixture in the cylinder, by applying a high holding force during these movements.

The compensation device according to the invention thus makes it possible to control the operating clearances existing between the moving members of the transmission device by applying a moderate average holding force throughout the engine cycle, and without using a mechanical stop.

According to other advantageous characteristics, not limitative of the invention, taken alone or in combination:

the transmitting device comprises:

- a bearing guide device supported by a wall of the engine block;
- a transmission member integral with a combustion piston, cooperating, on the one hand, with the bearing guide device and, on the other hand, with a first side of a toothed wheel;
- a control rack cooperating with a second side of the toothed wheel and adapted to move longitudinally on an opposite wall of the engine block;
- a connecting rod cooperating with the toothed wheel and connected to a crankshaft of the engine;

the pressing device is integral with the engine block;

the pressing device exerts the holding force onto the control rack;

the holding force has a threshold value;

the pressing device comprises a spring;

the pressing device comprises:

- a piston operating in a chamber filled with a fluid and having at least one calibrated drain port;
- a pressure source connected to the chamber; and
- a check valve between the source and the chamber;

the calibrated drain port is in fluid communication with the pressure source;

the chamber, the cylinder and the check valve are integrated in an independent air-tight diaphragm;

the calibrated drain port comes out onto the exposed surface of the piston; and the pressing device is in fluid communication with a hydraulic unit.

BRIEF DESCRIPTION OF THE DRAWINGS

The invention will be better understood when reading the following description of particular embodiments, which are not limiting to the invention, with reference to the accompanying figures in which.

DETAILED DESCRIPTION

Figure 1:
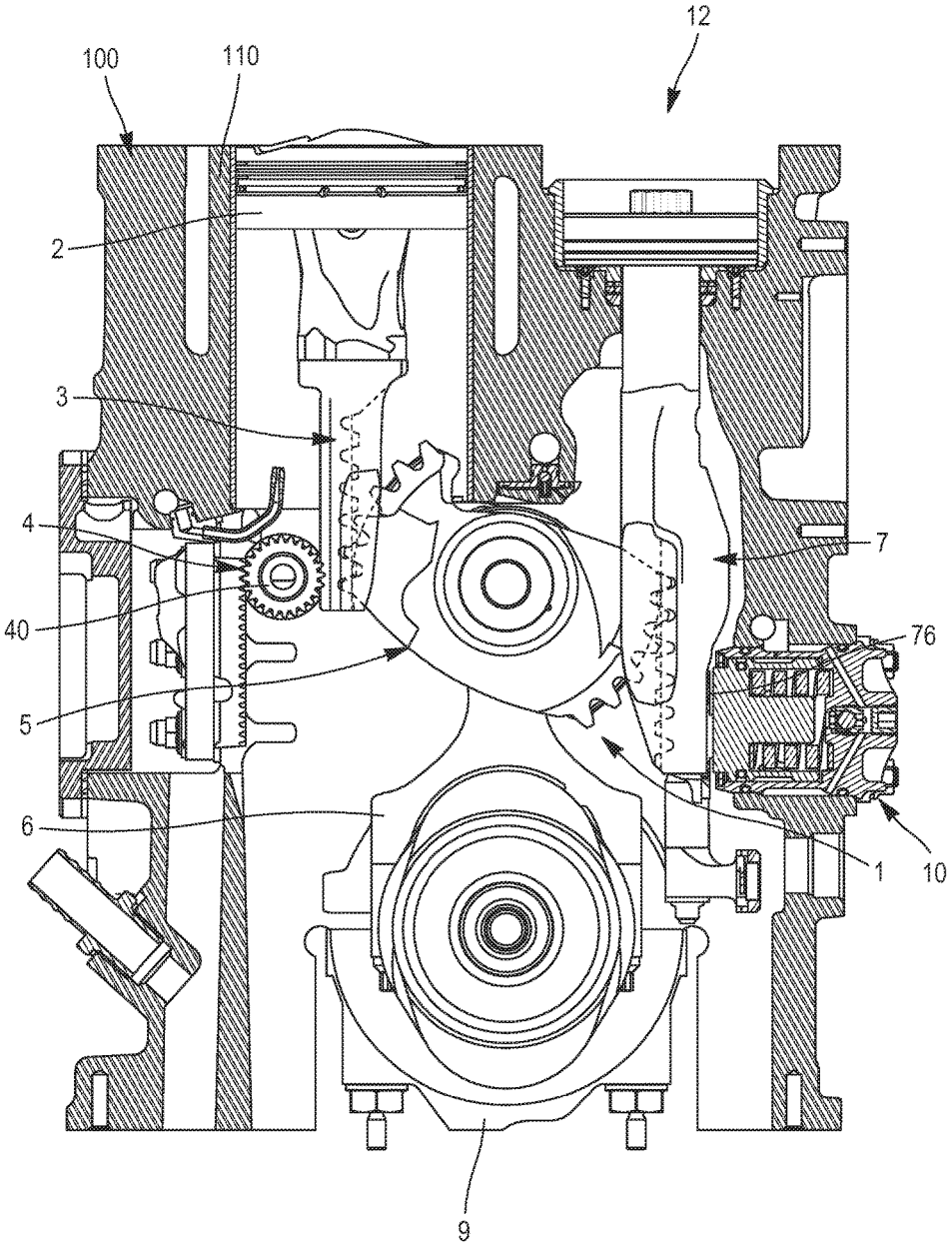
FIG. 1 shows a schematic overall sectional view of a particular configuration of the compensation device.

FIG. 1 shows an overall sectional and schematic view of a device for compensating for the operating clearances of an engine according to the invention and implemented in the case of a variable compression ratio engine.

In FIG. 1, an engine block 100 comprises at least one cylinder 110, wherein a combustion piston 2 causing rotation of a crankshaft 9 through a transmission device 1, moves in translation.

The transmission device 1 comprises a transmission member 3 integral with the combustion piston 2 and cooperating, on the one hand, with a bearing guide device 4 supported by a wall of the engine block 100 and, on the other hand, with a first side of a toothed wheel 5.

The transmission member 3 is provided on one of its faces with a first large-sized rack, the teeth of which cooperate with those of the toothed wheel 5. The transmission member 3 is also provided, opposite the first rack, with another rack, the teeth of which of small dimensions cooperate with those of a roller 40 of the bearing guide device 4 integral with the engine block 100.

The toothed wheel 5 cooperates with a rod 6 connected to the crankshaft 9 in order to ensure the transmission of the movement.

The toothed wheel 5 cooperates, on a second side opposite the transmission member 3, with a control rack 7 adapted to move longitudinally along an opposite wall of the engine block 100 and driven by a control device 12 having an actuating cylinder, the cylinder piston of which is guided in a cylinder casing of the engine block 100.

The control rack 7 has teeth that cooperate with those of the toothed wheel 5 and may have a rolling track, which cooperates with a rolling track of the toothed wheel 5. The control rack 7 also comprises, on its opposite side, a support surface 76, whereon the holding force of a pressing device 10 integral with the engine block 100 is exerted, in the particular configuration shown in FIG. 1.

As will be explained in greater detail here below, the pressing device 10 is so configured as to adjust the holding force to the instantaneous speed of the transverse displacement of the transmission device 1 in the engine block 100.

The control rack 7 and the control device 12 cooperate with the pressing device 10 so as to allow at least a translation of the control rack 7 in the vertical direction.

In the particular embodiment of the invention shown in FIG. 1, the pressing device 10 is integral with the engine block 100 and exerts the holding pressure onto the transmission device 1, the main components of which have just been mentioned.

In an alternative embodiment, the pressing device 10 may be incorporated in the transmission device 1, such as, for instance, the control rack 7 or the bearing guide device 4, and exert a force onto one of the walls of the engine block 100.

According to the invention, the holding force is adjustable to the instantaneous speed of the transverse displacement of the transmission device 1 in the engine block 100.

During the engine cycle, various phenomena induce transverse displacements of the transmission device 1 according to two modes:

- a first slow motion mode, linked to the existing differences between the geometries or the actual positions of the parts and the perfect geometry thereof, and such differences may be linked to deformations under load, to manufacturing tolerances, to differential expansion phenomena and wear. Such movements have a period equal to one revolution of the crankshaft 9;
- a second fast motion mode, mainly resulting from the peak force corresponding to the combustion of the mixture in a cylinder, and also resulting from the inertia of the moving members of the transmission device 1 in motion.

By adjusting the holding force to the speed of the transmission device motion, the invention thus makes it possible to tolerate the slow motions of the first mode, which are required for the correct engine operation, and to efficiently counter the fast motions of the second mode, which could oppose the correct engine operation or degrade the performances thereof.

The holding force is thus not static as is the case in the known solutions of the prior art. It does not specifically depend on the position of the transmission device 1 in the engine block 100.

During a motor cycle, the slow motion mode is primary, so much so that the average force applied to the transmission device 1 during an engine cycle is relatively small; and much less important than the one applied in the solutions of the prior art. Accordingly, the average friction forces between the movable components are reduced, the motor performances are improved, and the dimensions of the components of the transmission device 1, the engine block 100, and the hydraulic power source can be reduced.

On the other hand, outside the fast mode operating times, which are not primary during an engine cycle, the friction resulting from the holding force exerted by the pressing device 10 onto the control rack 7 are low. The movements of the control rack 7 are not limited.

An adjusted holding force means that the force exerted is variable according to the magnitude and/or the direction of the instantaneous speed of the transmission device 1.

When the transmission device 1 has an instantaneous transverse speed directed toward the pressing device 10, which may, for example, result from the forces applied to the transmission device 1 further to the combustion of the mixture in the cylinder of the engine containing the piston 2, the holding force has a first value.

In the absence of displacement or for low displacement instantaneous speeds, the holding force will have a second value, lower than the first one.

The second value is preferably greater than a non null threshold force value that the pressing device 10 exerts onto the transmission device 1 under any circumstance. The threshold value of the holding force ensures the cohesion and the cooperation of the moving components of the transmission device 1 and its being supported by the opposite wall of the engine block 100 in the absence of peak force exerted onto the transmission device 1.

"Cohesion and cooperation" mean that the moving components of the transmission means 10 are in contact or have a controlled clearance, which does not affect the engine operation.

The holding force can increase and continuously evolve with the transverse instantaneous speed of the transmission device 1. It may also increase and discontinuously evolve, for example, step-by-step, at the same speed.

The first value of the holding force is so determined as to ensure the cohesion and cooperation of the moving components of the transmission device 1 if a peak force is exerted. This first value may vary with the motion speed. It may also be adjusted according to the engine load or operating speed.

Figure 2A:
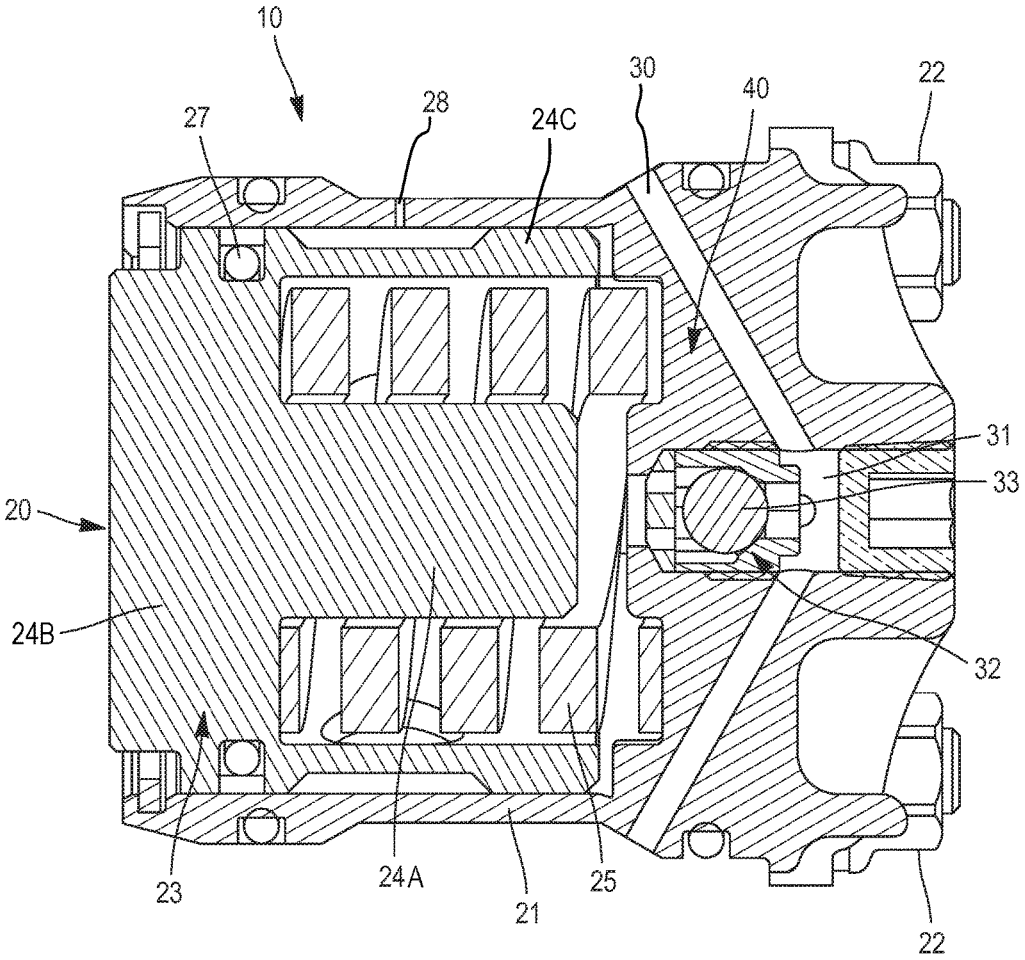
FIGS. 2*a* and 2*b* each show a sectional view of a particular configuration of the pressing device.

FIG. 2*a* shows a particular embodiment of a pressing device 10 for exerting a holding force according to the invention.

The pressing device 10 may comprise a, for example, cylindrical, chamber 21 engaged in a hole provided in the engine block 100. The pressing device 10 is assembled in the engine block 100 by fastening means 22, comprising, for example, a flange integral with the device and bolts screwed into the engine block 100.

The chamber 21 is provided with a piston 23, which confines the fluid in the chamber 21, and can evolve in translation in such chamber. The holding force is exerted onto the transmission device 1 through the piston head 24B of piston 23. Means 27 ensuring sealing, such as an O-ring seal member, are positioned between the cylinder and the piston 23.

The piston 23 comprises a central protruding portion 24A, which clears an annular space with an inner surface of the piston sleeve 24C of piston 23, thus making it possible to accommodate a spring 25, as will be explained in greater details here below.

The piston head 24B of piston 23 has an exposed surface 20 adapted to cooperate with the surface 76 supporting the control rack 7 (FIG. 1).

The chamber 21 is filled with a fluid such as oil, water or gas. This may be, for example, engine lubricating oil. Preferably, it is a hydraulic fluid.

The chamber 21 is also provided with at least one calibrated drain port 28. The calibrated drain port 28 enables a flow of the fluid outside the chamber 21, particularly when pressure is applied to the fluid through the piston 23.

The chamber 21 is supplied with fluid by means of a pressure source such as an accumulator (not shown in FIG. 2*a*) in fluid communication with the chamber 21, for example, through supply means such as a conduit and/or a channel 30 arranged in the chamber 21 and opening into a supply zone 31 of the chamber 21.

A check valve 32 positioned between the chamber 21 and the pressure source maintains a permanent minimum pressure of the fluid within the chamber 21, which is identical with the pressure in the source, and stops supply when the fluid pressure in the chamber 21 exceeds the fluid pressure in the source, as a result of a force exerted onto the piston 23.

As is well known per se, the check valve 32 may include a ball 33 positioned in a bore of the chamber 21 and closes off a supply channel from the supply zone 31 when the fluid pressure in the chamber 21 pushes same into abutment with the channel.

The combined arrangement of the piston 23, operating in a chamber 21 filled with a fluid and having at least one calibrated drain port 28, with the pressure source connected to the chamber 21 and the check valve 32 between the source and the chamber 21 results in a device capable of supplying a force adjusted to the motion speed of the piston 23. At low speed, the fluid contained in the chamber 21 flows through the calibrated drain port 28 without generating any substantial overpressure in the chamber 21; and the piston 23 exerts a low resistance force substantially equivalent to its pre-load threshold value. At high speed, the fluid contained in the chamber 21 cannot sufficiently flow through the drain port 28 and rises in pressure, and the piston 23 then exerts a high resistance force well above the pre-charge threshold.

The force-to-speed ratio may be calibrated by adjusting the size of the calibrated drain port 28 of the chamber 21, for instance.

The chamber 21 is also advantageously provided with a spring 25, which may be helical, for example, as shown in FIG. 2*a*. It may also be a spring of the "Belleville" type. The spring 25 may be positioned in the annular space formed between the central portion 24A and the inner surface of the piston sleeve 24C of piston 23, as shown in FIG. 2*a*, but it may also be arranged outside the chamber 21.

Whatever the chosen location thereof, the pressure exerted by the hydraulic part of the pressure device 10 complements the pressure exerted by the spring 25. The hydraulic part can then have smaller dimensions and especially have a reduced fluid static pressure. For instance, the spring 25 may be so selected as to contribute, between 20% and 40%, to the threshold force exerted by the pressing device 10. A 33% contribution will preferably be chosen. The presence of the spring 25 also provides a better response from the pressing device 10 during oil replenishment phases, during which the piston 23 must nevertheless quickly exert a pressure onto the control rack 7. Eventually, the presence of the spring 25 enables the engine to operate in a degraded mode in case of failure of the hydraulic part of the pressing device 10, while ensuring the functionality of the pressing device 10 on a limited engine operating range.

The pressing device 10 may comprise a calibrated drain port 28 in fluid communication with the pressure source. Such connection may be provided by conduits if the pressure source is distant, or the calibrated drain port 28 may directly supply a tank of the pressure source.

The chamber 21, the piston 23 and the check valve 32 may advantageously be incorporated in an independent air-tight diaphragm; then forming an independent pressing device 10.

If the pressure source is distant, it may be in fluid communication with the assembly of the pressing device 10 of the engine for a centralized control of the hydraulic unit.

When the chamber 21 fluid consists of the engine lubricating oil, the calibrated drain port 28 can be positioned in the piston 23 itself and open onto the exposed surface 20 of the piston 23, specifically in order to lubricate the contact surfaces of the control rack 7 and the pressing device 10.

A pump of the hydraulic unit may be provided for adjusting the fluid static pressure in the pressure source, and consequently the static pressure of the fluid in the pressing device 10. This adjustment may be determined according to the engine load and operation speed. For this purpose, the hydraulic unit may include a computer, connected to sensors adapted for measuring, among other things, the load level and speed. The computer is programmed to determine a target static pressure and controls the pump so as to cause the static pressure of the accumulator to reach the target static pressure.

The specific configuration of the pressing device 10 shown in FIG. 2*a* has a single calibrated drain port 28; but additional calibrated drain ports may be provided for.

Figure 2B:
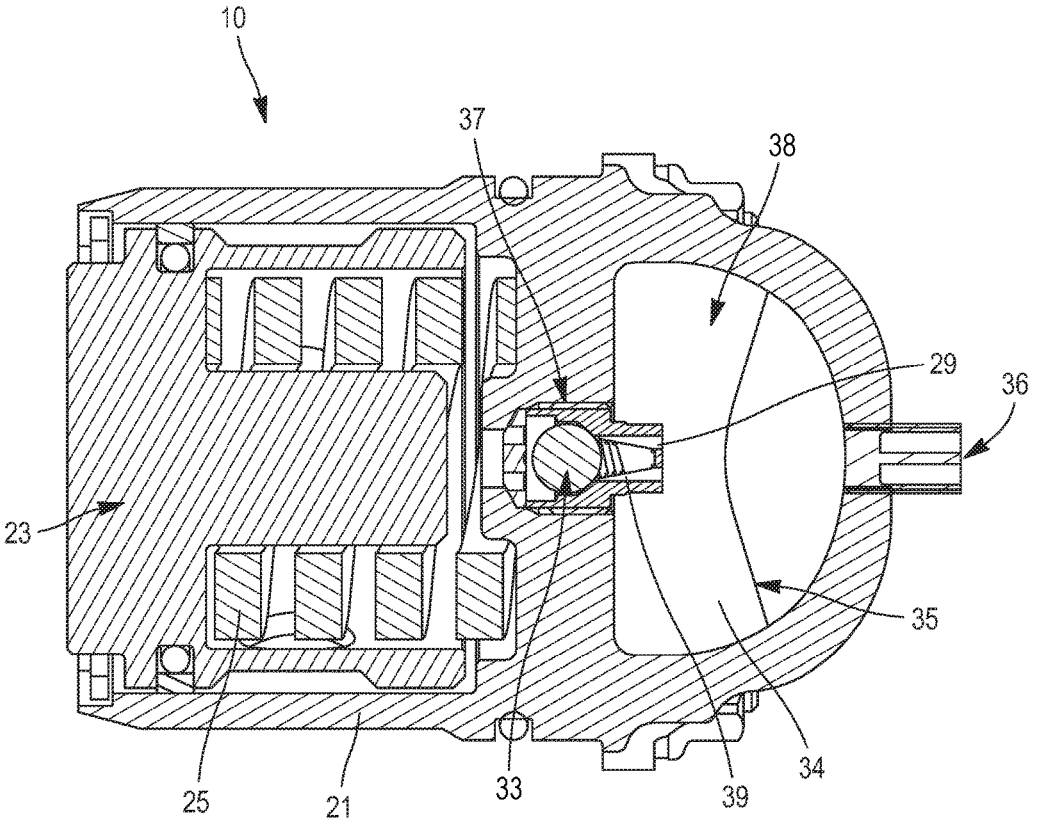

FIG. 2*b* shows another embodiment of a pressing device 10 for exerting a holding force according to the invention.

FIG. 2*b* also shows the piston 23, the chamber 21 and the spring 25 of the previous embodiment. In this new embodiment, the pressing device 10 is associated with a pressure source 38 consisting of a tank 34 having a sealing diaphragm 35 confining the fluid in the source tank 34. A source opening 36 makes it possible to introduce a gas for pressurizing the fluid contained in the tank 34. A pressure device 10 integrated in a compact air-tight diaphragm, also incorporating the source is thus formed.

In this embodiment, the calibrated drain port is integrated in the check valve 37. It comprises a ball 33 positioned in a bore of the chamber 21 communicating with the pressure source 38. A spring 39 is positioned in the bore, between the ball 33 and a wall of the pressure source 38.

When the fluid pressure in the source exceeds the fluid pressure in the chamber 21, the ball 33 is pushed back toward the cylinder to give way to the fluid and ensure pressure balance.

When the fluid pressure in the chamber 21 slightly exceeds the pressure of the fluid source, the spring 39 hinders movement of the ball 33 and allows the fluid to flow to the source, thereby forming a calibrated drain port 29.

When the fluid pressure in the chamber 21 largely exceeds the fluid pressure of the source, the spring 39 is so compressed that the ball 33 totally closes off the calibrated drain port 29.

It is thus possible to create discontinuity in the relationship between the piston speed and the holding force. When the piston operates at a speed leading to the closing off of the drain port, the pressure exerted by the piston of the pressing device 10 reaches its nominal value.

Whatever the selected embodiment of the pressing device 10, it may also form a mechanical stop for the transmission device 1. Abutment is provided, for instance, when the end of the piston sleeve 24C of piston 23 or the central portion 24A thereof comes into contact with the bottom of the chamber 21. Such mechanical stop, however, is not intended to be biased during the normal operation of the engine, but may be a safety means for preventing the disengagement of the moving components from the transmission device 1 in case of anomalies such as a failure of the engine hydraulic system, and complement the spring when the latter is present.

The advantages of the present invention are illustrated with reference to FIGS. 3*a*-3*d* and FIGS. 4*a*-4*d*. FIGS. 3*a*-3*d* are graphic representations of the evolution of certain parameters of a 4-stroke variable compression ratio engine during an engine cycle, i.e., during a 720° rotation of the crankshaft. The engine is provided with a hydraulic cylinder exerting a static load onto the transmission device of this engine.

Figures 3A, 3B, 3C, 3D:
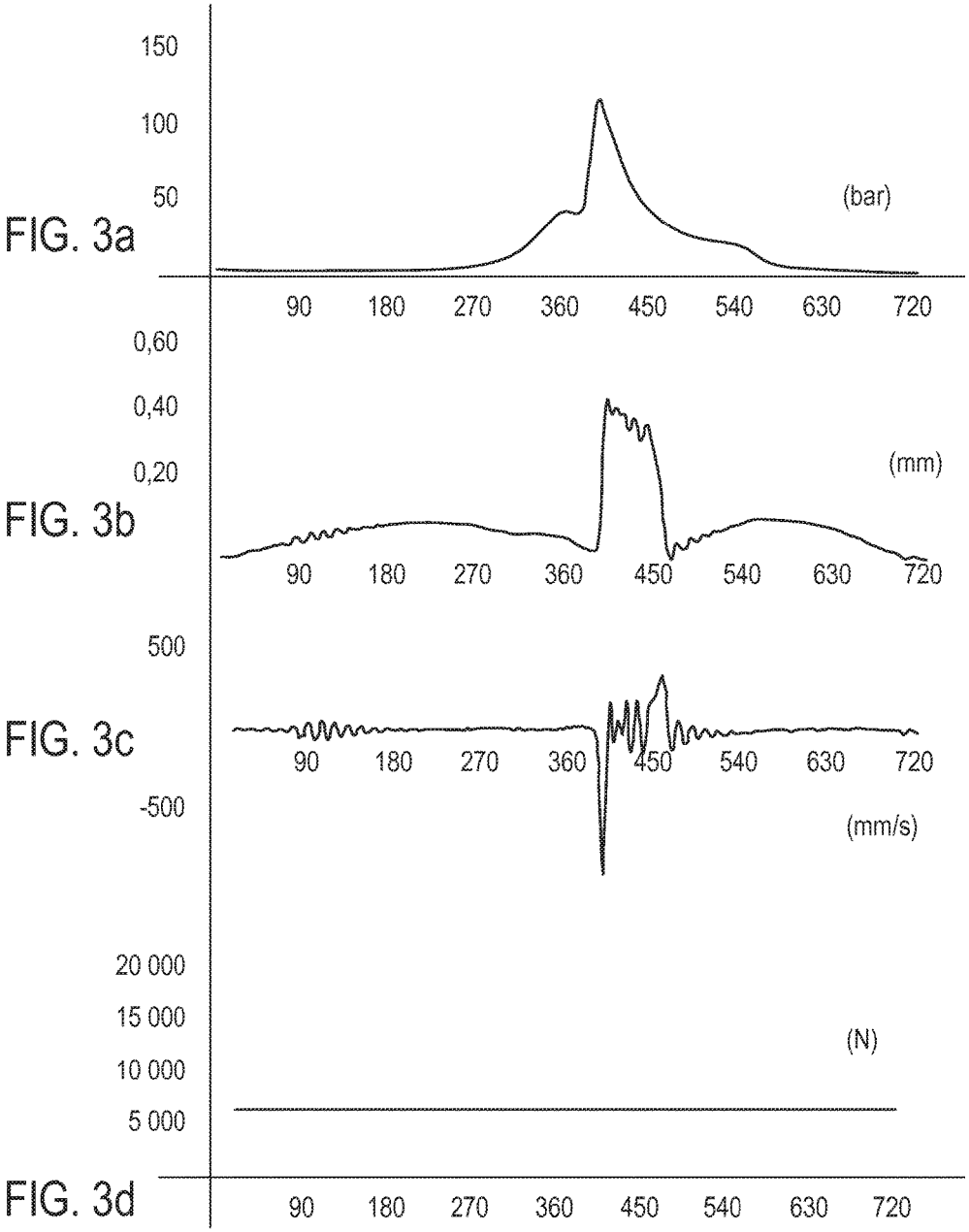
FIGS. 3*a*-3*d* are graphical representations of the evolution of certain parameters during an engine cycle of a variable compression ratio engine according to the prior art.

FIG. 3*a* shows the evolution of pressure in the cylinder. A steep pressure peak corresponding to the explosion of the combustion mixture in the cylinder can be noted.

FIG. 3*b* shows the displacement of the transmission device during the engine cycle; and FIG. 3*c* shows the speed of the transmission device during the engine cycle. The slow motion mode is clearly shown in FIGS. 3*b*-3*c* having small amplitude (of the order of 0.1 mm) and slow displacements for most of the engine cycle. The fast motion mode, with displacements of greater amplitudes (up to 0.4 mm) and speed (exceeding+/−100 mm/s), substantially between a 360° angular position and a 420° angular position of the crankshaft and corresponding to a pressure peak in the cylinder are also clearly visible. It should also be noted that, during such peak, the transmission device mechanically abuts the engine wall, as evidenced by the leveling of the displacement at +0.4 mm in FIG. 3*b*, as well as the steep speed variation which is visible in FIG. 3*c*.

FIG. 3*d* shows the pressure applied by the hydraulic jack onto the transmission device. It should be noted that the static level thereof is about 6 kN.

FIGS. 4*a*-4*d* are graphic representations of the evolution of the parameters of a variable compression ratio engine, comprising the pressing device 10 according to the invention, thus exerting a holding force adjusted to the instantaneous speed of transverse displacement of the transmission device.

In the particular case of FIGS. 4*a*-4*d*, the pressing device 10 consists of an independent air-tight diaphragm, comprising a piston moving in a chamber filled with a fluid and having at least one calibrated drain port, an external source of 30-bar pressure is connected to the chamber, and a check valve is positioned between the source and the chamber.

Figure 4A:
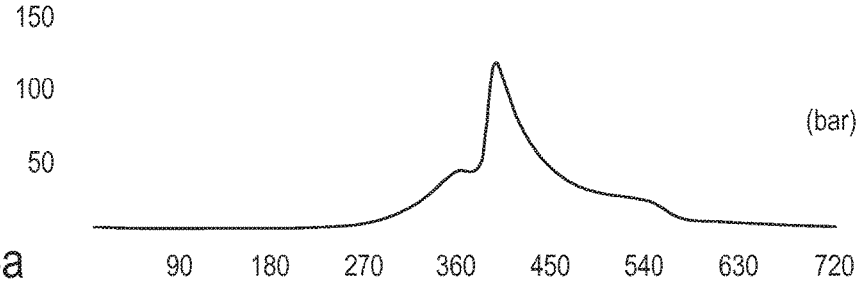
FIGS. 4*a*-4*d* are graphical representations of the evolution of certain parameters during an engine cycle of a variable compression ratio engine according to the invention.

FIG. 4*a* shows the evolution of pressure in the cylinder, similar to what is shown in FIG. 3*a* in the solution of the prior art.

Figure 4B:
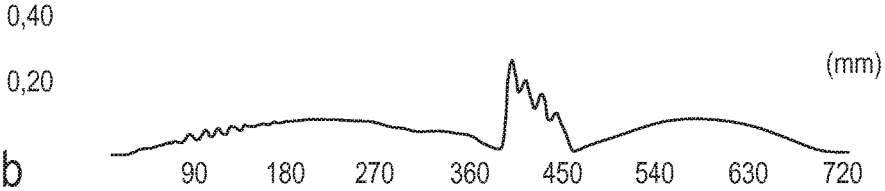
Figure 4C:
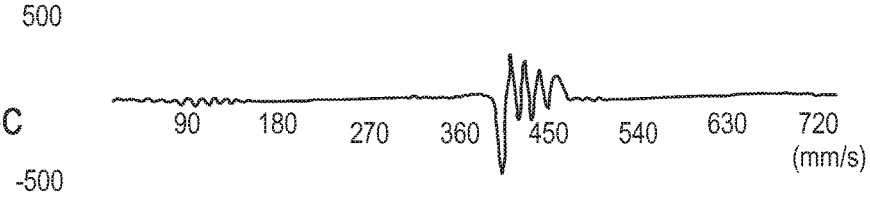

FIGS. 4*b* and 4*c*, respectively, show the displacement and speed of the transmission device 1 during the engine cycle. The slow motion mode has displacement amplitudes similar to those shown in FIG. 3*b*, of the order of 0.1 mm. However, it should be noted that in the fast motion mode, the displacement amplitude of the transmission device 1 remains less than 0.4 mm, which prevents its abutment against the engine block 100.

Figure 4D:
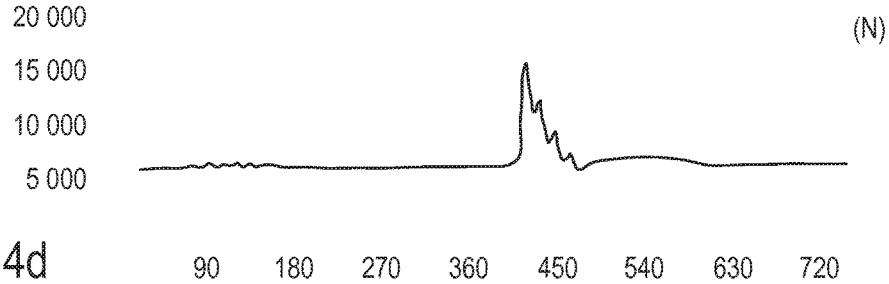

This result is all the more remarkable since the force exerted by the pressing device 10 onto the transmission device, shown in FIG. 4*d*, is at the same level as the solution according to the prior art of FIG. 3*c*, outside the period corresponding to the steep pressure peak. Thus, in the slow motion mode, this force is of the order of 6 kN; and in the fast motion mode, this force briefly reaches a maximum of 16 kN. The invention thus makes it possible, for an identical force and during most of the engine cycle, to prevent the transmission device 1 from abutting against the wall of the engine block 100.

Of course, the invention is not limited to the described embodiments and alternative embodiments can be applied thereto without departing from the scope of the invention as defined by the claims.

In particular, although the application of the holding force by the pressing device 10 of the control rack 7 has been described, it is quite possible, without departing from the scope of the invention, for such force to be applied to other elements of the transmission device 1. Positioning the pressing device 10 between the wall of the engine block 100 and the bearing guide device 4 may also be provided for.

And although a special pressing device 10 has been disclosed, while referring to FIG. 2, for the purposes of the complete description of the invention, in some cases, within the scope of the invention, using other forms of the pressing device providing the same functions as those described may be preferred. This may thus be, for example, a device comprising viscous or hyper viscous polymer-based shock absorbing means as disclosed in U.S. Pat. No. 5,495,923, or comprising shock absorbing electromagnetic means as disclosed in U.S. Pat. No. 7,537,097, the disclosures of which are incorporated herein in their entireties by this reference.

The invention claimed is:

1. A device for compensating for operating clearances of an engine, comprising:

a transmission device likely to move transversely in an engine block during an engine cycle;

a pressing device exerting a holding force onto the transmission device, the pressing device comprising a piston operating in a chamber filled with a fluid and a pressure source connected to the chamber, the pressing device further comprising a check valve between the pressure source and the chamber, and wherein the chamber has at least one calibrated drain port to adjust the holding force responsive to an instantaneous speed of transverse movement of the transmission device in the engine block.

2. The device of claim 1, wherein the transmission device comprises:

a bearing guide device supported by a wall of the engine block;

a transmission member, integral with a combustion piston, cooperating with the bearing guide device and with a first side of a toothed wheel;

a control rack cooperating with a second side of the toothed wheel and adapted to move longitudinally on an opposite wall of the engine block;

a connecting rod cooperating with the toothed wheel and connected to a crankshaft of the engine.

3. The device of claim 2, wherein the pressing device is integral with the engine block.

4. The device of claim 3, wherein the pressing device exerts the holding force onto the control rack.

5. The device of claim 1, wherein the holding force has a threshold value.

6. The device of claim 1, wherein the pressing device comprises a spring.

7. The device of claim 6, wherein the spring is accommodated in the chamber.

8. The device of claim 1, wherein the calibrated drain port is integrated in the check valve.

9. The device of claim 8, wherein the calibrated drain port is in fluid communication with the pressure source.

10. The device of claim 8, wherein the calibrated drain port comes out onto an exposed surface of the piston.

11. The device of claim 8, wherein the chamber, the piston, and the check valve are integrated in an independent air-tight diaphragm.

12. The device of claim 11, wherein the source of pressure is also integrated in the independent air-tight diaphragm.

13. The device of claim 1, wherein the pressing device is in fluid communication with a hydraulic unit.

14. A variable compression ratio engine comprising the compensation device according to claim 1.

15. The device of claim 2, wherein the pressing device exerts the holding force onto the control rack.

16. The device of claim 1, wherein the calibrated drain port is in fluid communication with the pressure source.

17. The device of claim 1, wherein the calibrated drain port comes out onto an exposed surface of the piston.

18. The device of claim 1, wherein the chamber, the piston, and the check valve are integrated in an independent air-tight diaphragm.

19. The device of claim 18, wherein the source of pressure is also integrated in the independent air-tight diaphragm.

20. The device of claim 1, wherein the pressure source is static.

* * * * *